United States Patent [19]

Hasegawa

[11] Patent Number: 4,780,640

[45] Date of Patent: Oct. 25, 1988

[54] PROJECTION TELEVISION RECEIVER WITH LIQUID-COOLED LENS

[75] Inventor: Shinichi Hasegawa, Tokyo, Japan

[73] Assignee: Pioneer Electronic Corporation, Japan

[21] Appl. No.: 42,890

[22] Filed: Apr. 27, 1987

[30] Foreign Application Priority Data

Dec. 19, 1986 [JP] Japan ..... 61-301589

[51] Int. Cl.[4] ..... H01J 29/89; H01J 7/24

[52] U.S. Cl. ..... 313/36; 313/477 R; 313/478

[58] Field of Search ..... 313/36, 35, 22, 477 R, 313/478; 252/73 (U.S. only)

[56] References Cited

U.S. PATENT DOCUMENTS

| | | | |
|---|---|---|---|
| 3,809,152 | 5/1974 | Boehmer | 252/73 X |
| 4,529,905 | 7/1985 | Ohkoshi et al. | 313/477 R X |
| 4,538,089 | 8/1985 | Fitzpatrick | 313/478 |
| 4,609,945 | 9/1986 | Oguino | 358/233 X |
| 4,612,582 | 9/1986 | Tucker | 358/237 |
| 4,665,336 | 5/1987 | Howden | 313/478 X |

OTHER PUBLICATIONS

"Industrial Solvents Handbook" (Second Edition), by Noyes Data Corp., Park Ridge, N.J., U.S.A., 1970, pp. 183, 184, 185, 201, 203, 204, 232, 233.

*Primary Examiner*—Palmer C. DeMeo

*Attorney, Agent, or Firm*—Finnegan, Henderson, Farabow, Garrett and Dunner

[57] ABSTRACT

A projection television receiver comprises at least one cathode ray tube for receiving video signals and projecting images therefrom, the tube including a face; a lens mounted adjacent to the face for focusing the images projected by the tube; and a coolant disposed between the lens and the face for absorbing and dissipating heat from the tube, the coolant means including 1,3-butylene glycol.

9 Claims, 3 Drawing Sheets

PROJECTION TELEVISION RECEIVER WITH LIQUID-COOLED LENS

BACKGROUND OF THE INVENTION

1. Field of the Invention

The present invention generally relates to projection television receivers, and particularly relates to cooling liquids for cooling a projection cathode ray tube in a projection television receiver.

2. Description of the Background Art

The present invention relates to an improvement in the projection television receiver disclosed in my U.S. Pat. No. 4,725,755 issued Feb. 16, 1988, and assigned to Pioneer Electronics Corporation.

Referring to FIG. 1, a conventional cooling system for a projection television receiver will be described.

In FIG. 1, a projection cathode ray tube 21 and a glass plate 22 are bonded with each other through a silicon group adhesive agent 24. A radiator 23 is interposed between the projection cathode ray tube 21 and a glass plate 22 such that a space is formed between the projection cathode ray tube 21 and a glass plate 22. The space is filled with cooling liquid A poured through a screw hole 23*a* opened to the radiator 23. The screw hole 23*a* is sealed by means of a packing 26 and a screw 25 after the cooling liquid has been inserted. The reference numeral 27 designates a lens.

When a signal is applied to the projection cathode ray tube 21, the front face of the cathode ray tube 21 is heated up. If there were no cooling system, as described above, the temperature would reach about 120° C. at the center portion of the front face and about 72° C. at the periphery of the same, and the temperature at the fluorescent surface of the projection cathode ray tube 21 could reach values higher by 20° C. than those at the front face.

Accordingly, if the above-mentioned space is filled with the cooling liquid A as described above, convection is effected in the cooling liquid A as shown in FIG. 2, in such a manner that the heat at the center portion of the projection cathode ray tube 21 is transmitted to the cooling liquid A and the heated cooling liquid A moves up to the radiator 23. Thus, the heat of the cooling liquid A is absorbed to be exhausted outside by the radiator 23. The thus cooled liquid A in the radiator 23 then moves down again by thermosiphoning into the space.

As the cooling liquid, a mixture of ethylene glycol and water is used with a ratio of the former to the latter of about 4:1. The physical properties of the cooling liquid are as shown in the following Table.

Since the refractive index of the cooling liquid A is 1.41, the reflection factor ($R_1$, $R_2$) at the boundary in the structure as shown in FIG. 1 is as follows.

$$R1 = R2 = \left(\frac{1.54 - 1.41}{1.54 + 1.41}\right)^2 \times 100 = 0.19\%$$

where 1.54 is a value of the refractive index of the glass. Thus, the total reflection factor at the boundaries between the cooling liquid A and the projection cathode ray tube 21, and between the cooling liquid A and the glass plate 22 reaches 0.38%. This has been a cause of a marked decrease in contrast in conventional projection television receivers.

Since the cooling liquid A contains 20% of water, the vapor pressure reaches 0.47 atm at a temperature of 100° C., and this vapor pressure acts directly on the projection cathode ray tube 21, as well as the glass plate 22, with a risk of damage of those components.

TABLE

| | | Cooling liquid of the Invention 1-3-butylene glycol | Cooling liqud of the Prior Art Mixture of ethylene glycol and water (20 weight %) |
|---|---|---|---|
| Refractive index | | 1.441 | 1.41 |
| Boiling point | | 207.5° C. | 126° C. |
| Solidifying point (Melting point) | | −77° C. | −45° C. |
| Flash point | | 121° C. | 118° C. |
| Toxicity | | 22.8 | 6.1 |
| $LD_{50}$(g/Kg) | | extreamly low | little |
| Vapor pressure | 80° C. | 0.004 (atm) | 0.22 (atm) |
| | 100° C. | 0.012 (atm) | 0.47 (atm) |
| | 120° C. | 0.033 (atm) | 0.94 (atm) |

If the glass plate 22 is replaced by a plastic lens, the plastic material of the lens may absorb the water and become cloudy white because the cooling liquid contains a large quantity, about 20%, of water. Accordingly, a plastic lens cannot be used at the point where the lens comes into contact with the water. Therefore if a plastic lens is used, it must be disposed in front of a heavier glass plate 22 preventing any substantial reduction in weight or cost.

It is another object of the present invention to provide a liquid lens for a projection television receiver, in which the reflection factor at boundaries can be made smaller to make the contrast higher, in which the vapor pressure can be low to eliminate the risk of damage of the projection cathode ray tube or the like, and in which a plastic lens can be used and the plastic lens can constitute a direct cooling surface. Thus, it is possible to reduce the weight, as well as the cost of the device.

Other features and advantages of the invention will be apparent from the following description taken in connection with the accompanying drawings.

Further, ethylene glycol has a toxicity. When using ethylene glycol in production line operators, careful treatment, such as ventilation, is required because ethylene glycol vapors are harmful to operators.

SUMMARY OF THE INVENTION

In order to achieve the above objects and advantages, the projection television receiver of the present invention comprises at least one cathode ray tube for receiving video signals and projecting images therefrom, the tube including a face; lens means mounted adjacent to the face for focussing the images projected by the tube; and coolant means between the lens means and the face for absorbing and dissipating heat from the tube, the lens means and the coolant means having substantially the same refractive index, for reducing reflection of the images.

Particularly, the coolant means includes a liquid of 1-3-butylene glycol. The coolant means may also include a liquid mixture of 1-3-butylene glycol and ethylene glycol, and it is also allowable that the mixture of 1-3-butylene glycol and glycerol.

The term "television receiver" is intended to mean a television receiver, a monitor or the like.

BRIEF DESCRIPTION OF THE DRAWINGS

The accompanying drawings, which constitute a part of the specification, illustrate one embodiment of the invention, and, together with the description, serve to explain the principles of the invention. Of the drawings.

DESCRIPTION OF THE PREFERRED EMBODIMENT

Figure 1:
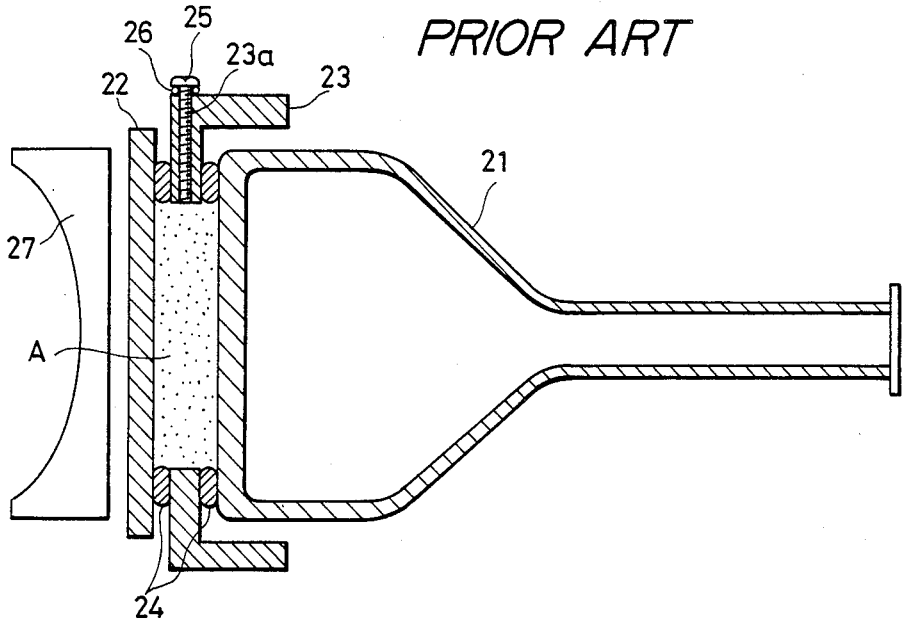
FIG. 1 PRIOR ART
FIG. 1 is a cross-section of the conventional projection cathode ray tube provided with a cooling system.
Figure 2:
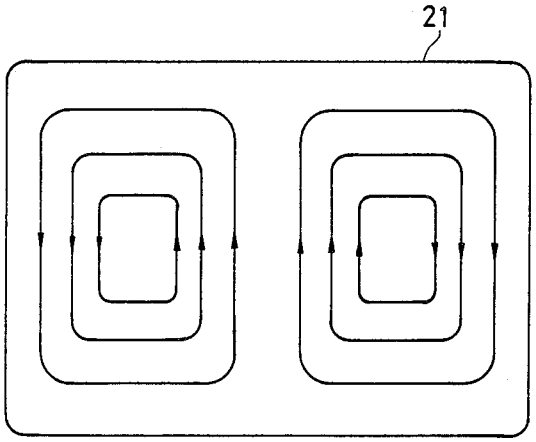
FIG. 2 is an explanatory diagram showing the convection of the cooling liquid on the front face of the projection cathode ray tube.
Figure 3:
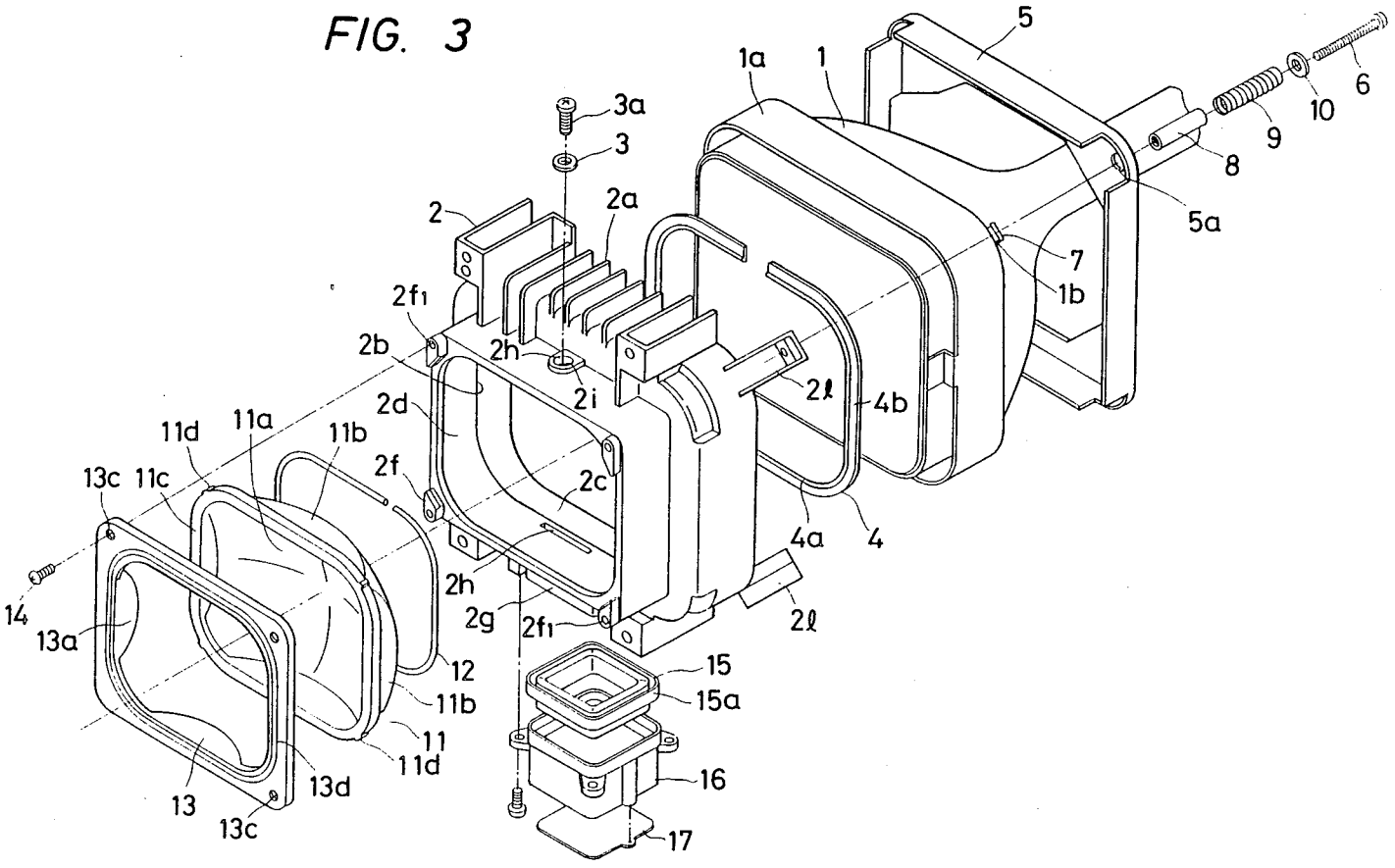
FIG. 3 is an exploded perspective view of the whole projection apparatus.
Figure 4:
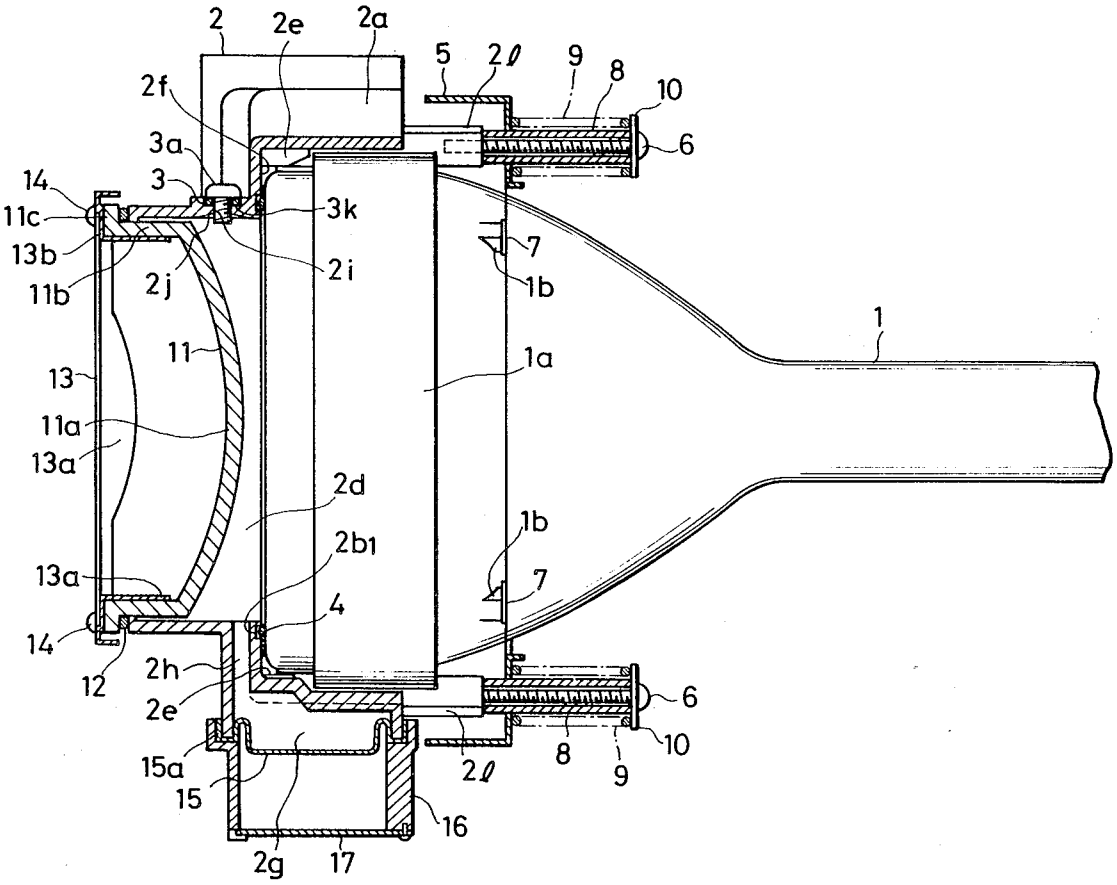
FIG. 4 is a cross-section showing the assembled state of FIG. 3.

Referring to the drawings, the present preferred embodiment now will be described. In the illustrated embodiment, description is made as to one of three monochromatic projection cathode ray tubes constituting a projection television receiver.

In the drawings, a projection cathode ray tube 1 is provided with a metal belt 1*a* secured to a side edge outer periphery thereof close to a fluorescent screen thereof for interrupting emission of X-rays. A frame 2 of die-cast aluminum is provided with a large number of fins 2*a* formed on an upper portion of an outer peripheral surface thereof. A step portion 2*b* is located at an inner central portion of the frame 2 to form a large-sized chamber 2*c* for mounting the projection cathode ray tube 1 therein. This projection cathode ray tube chamber 2*c* is formed at one side of the step portion 3*b*, and a small-sized chamber 2*d* for enclosing a cooling liquid A (described later) is formed at the other side of the step portion 2*b*.

Respective protrusions 2*e* are formed at the four corners of the inner surfaces of the side walls defining the projection cathode ray tube chamber 2*c*, such that the protrusions 2*e* abut on the side edge outer periphery of the projection cathode ray tube 1. This disposes the projection cathode ray tube 1 in position on the frame 2. Respective protrusions 2*f*, on the other hand, are formed at the four corners of the end surfaces of the side walls defining the cooling liquid chamber 2*d* such that the protrusions 2*f* abut on small protrusions 11*d* of a lens 11 described later. This disposes the lens 11 in position on the frame 2. Thus, the center line of the projection cathode ray tube 1 is made coincident with that of the lens 11 because the projection cathode ray tube 1 and the lens 11 can be disposed in position on the frame 2. Further, a through hole 2*h* is formed in the frame 2. One end of the through hole 2*h* is opened to the inside of the lower side wall defining the cooling liquid chamber 2*d*, and the other end of the through hole 2*h* is opened to a pressure regulating chamber 2*g* formed under the lower side wall defining the projection cathode ray tube chamber 2*c*. A cooling liquid pouring hole 2*i* is formed at a center portion of the upper side wall defining the cooling liquid chamber 2*d*. The upper surface of the upper side wall is tapered toward the cooling liquid pouring hole 2*i*. The upper side wall also has a lower taper surface 2*j*, tapered to the lower edge of the cooling liquid pouring hole 2*i*, so that the upper side wall defining the cooling liquid chamber 2*d* has double taper surfaces. A large diameter hole portion 3*k* is formed at the upper end of the cooling liquid pouring hole 2*i*, so that the packing 3 can be fitted into the large diameter hole portion 3*k*.

A thin-plate ring-like rectangular packing 4 is provided with an expanded inner edge portion 4*a*, which is rectangular in section and which is sized to fit into a slot $2b_1$ formed in the inner surface of the step portion 2*b* of the frame 2.

A metal pressing plate 5 is inserted onto the projection cathode ray tube 1 from the rear for fixing the projection cathode ray tube 1 on the frame 2.

The projection cathode ray tube 1 is inserted into the frame 2 with the projection face of the projection cathode ray tube 1 facing the projection cathode ray tube chamber 2*c* of the frame 2. The projection face of the projection cathode ray tube 1 comes into abutting relation with the packing 4, because the packing 4 has been disposed in the slot $2b_1$ of the step portion 2*b* of the frame 2. The pressing plate 5 is inserted onto the projecting cathode ray tube 1 from the rear, and respective screws 6 are inserted into through holes 5*a* of the pressing plate 5 to be tightened into frame attaching pillar portions 2. This fixes the projection cathode ray tube 1 securely on the frame 2. The pressing plate 5 abuts, via elastic materials 7, against supporting portions 1*b* which project from the back surface of the projection cathode ray tube 1. Thus, the projection cathode ray tube 1 is attached onto the frame 2 so that the packing 4 is deformed by the fastening force of the screws 6 (at four corners of the pressing plate 5).

If the pressing force of the projection cathode ray tube 1 exerted onto the whole packing 4 is not uniformly a gap may be partially produced between the projection cathode ray tube 1 and the frame 2. This allows the cooling liquid to leak through the gap even when small amounts of vapor are produced, as will be described later. Therefore, it is necesary to uniformly fasten the pressing plate 5 onto the frame 2. In this embodiment, accordingly, a spacer 8 is inserted into each of the holes 5*a* of the pressing plate 5 so that one end of the spacer 8 made to abuts on the respective frame attaching pillar portion 2. A spring 9 is fitted onto the outer periphery of the spacer 8 with one end of the spring 9 made to abut on the pressing plate 5. Then, the respective screw 6 with a washer inserted thereto is screwed into the corresponding frame attaching pillar 2 through the spacer 8, and fastened so as to make the washer 10 abut against the other end of the spacer 8. This compresses the spring 9. As a result, the pressing plate 5 presses the projection cathode ray tube 1 at four portion thereof by the spring force of the springs 9 to urge the projection cathode ray tube 1 against the packing 4 under a uniform pressing force. Thus, no gap is generated between the step portion 2*b* of the frame 2 and the projection face of the projection cathode ray tube 1.

The lens 11 made of acrylic resin or the like has only one curved surface 11*a* with a predetermined radius of curvature, and includes four sides which are cut-off so as to form right angles between adjacent sides thereof so as to appear rectangular in plan. A perpendicular wall portion 11*b* is formed in each of the four cut-off sides and a collar portion 11*c* is formed integrally with the lens 11 along the whole periphery thereof.

The four corners of the lens surface 11*a* are rounded in order to prevent a crack from being generated at the corner portions when a pressure is applied to the curved surface 11*a* in this embodiment. However, it is not always necessary to round the corners. Further, small protrusions 11*d* are formed at corner portions of the collar portion 11*c* so as to abut on the protrusions 2*f* of the frame 2, respectively.

A packing 12 having a circular cross-section is fitted on the collar portion 11*c* of the lens 11. A metal lens adaptor plate 13 is sized to surround the collar portion 11*c* of the lens 11. Light-shading portions 13*a*, sized for fitting on inner surfaces of the respective perpendicular wall portions 11*b* of the lens 11, are formed integrally with the lens adaptor plate 13. A step portion 13*b*, arranged for mating with the collar portion 11*c* of the lens 11, is formed in the lens adaptor plate 13.

The lens 11 is disposed on the end surface of the side wall constituting the cooling liquid chamber 2*d* of the frame 2 with the curved surface 11*a* made to face the lens adaptor plate 13. The packing 12 is interposed between the collar portion 11*c* of the lens 11 and the end surface of the side wall defining the cooling liquid chamber 2*d*. The small protrusions 11*d* of the lens 11 are made to abut on the side surfaces of the protrusions 2*f* of the frame 2, respectively, to thereby guide the lens 11 in to position on the frame 2.

The lens adaptor plate 13 surrounds the collar portion 11*c* of the lens 11. Respective screws 14 are inserted into holes 13*c* formed in the four corners of the lens adaptor plate 13, and are tightened into screw holes $2f_1$. The holes $2f_1$, are formed in upper surfaces of the protrusions 2*f* of the frame 2. Thus, the lens 11 is securely fixed on the frame 2. The collar portion 11*c* of the lens 11 is attached on the frame 2 in sandwich relationship between the step portion 13*b* of the lens adaptor plate 13 and the packing 12. Thus, only compression stress is exerted onto the collar portion 11*c*, with no bending stress.

Although the step portion 13*b* is formed in the lens adaptor plate 13 in this embodiment, a projection alternatively may be formed on the collar portion 11*c* of the lens 11 at a position opposite to the lens adaptor plate 13.

At least the light-shading portion 13*a* of the lens adaptor plate 13 are made opaque, for example, by being painted black, so that light transmitted through the lens 11 is not reflected by the lens adaptor plate 13.

The pressure regulating chamber 2*g* of the frame 2 is covered with a diaphragm 15. A fastening ring 16 is fitted on the outer periphery 15*a* of the diaphragm 15 and fixed on the frame 2 by screws. Thus, the diaphragm 15 is fixed at an opening portion of the pressure regulating chamber 2*g* of the frame 2 by the fastening ring 16. An opening of the fastening ring 16 is covered by a cap 17.

The functioning of the projection apparatus according to the present invention will now be described.

First, the projection cathode ray tube 1 is mounted onto the projection cathode ray tube chamber 2*c* of the frame 2 having the fins 2*a*. At this time, the packing 4 is disposed in the slot $2b_1$ of the step portion 2*b*, and the projection face of the projection cathode ray tube 1 is caused to abut against the packing 4. In this state, the four-corner portions of the projection cathode ray tube 1 abut against the protrusions 2*e* inwardly projectingly formed on the inner surfaces of the four corners of the projection cathode ray tube chamber 2*c*. Thus, the projection cathode ray tube 1 is disposed in position on the frame 2. The pressing plate 5 is then inserted from the rear of the projection cathode ray tube 1, and mounted on the supporting portions 1*b* formed on the back surface of the projection cathode ray tube 1 through the elastic materials 7, respectively. The screws 6, each having the washer 10, the spring 9, and the spacer 8 fitted thereon in that order, are inserted into the respective holes 5*a* of the pressing plate 5 and are screwed into the respective frame attaching pillar portions 2. Further, the screws 6 are tightened so as to make the washers 10 abut on the corresponding spacers 8, thereby fixing the pressing plat 5 and the frame 2 to each other by the spring force of the respective springs 9. Thus, the projection cathode ray tube 1 is pressed at its four corners by the spring force of the springs 9, respectively. Therefore, the projection cathode ray tube 1 is fixed on the step portion 2*b* of the frame 2 in a sealed state by the uniform force. It is easy to dispose the packing 4 in place on the frame 2, because the expanded portion 4*a* of the packing 4 is fitted in the slot $2b_1$ of the step portion 2*b* of the frame 2. Further, the contact area between the projection cathode ray tube 1 and the packing 4 is made large because the expanded portion 4*a* and the flat portion 4*b* of the packing 4 come into contact with the projection cathode ray tube 1, and the expanded portion 4*a* is substantially deformed when the projection cathode ray tube 1 is urged against the expanded portion 4*a*. Therefore, it is possible to keep a fluid-tight seal between the projection cathode ray tube 1 and the step portion 2*b* of the frame 2.

The lens 11 is mounted then onto the frame 2. First, the packing 12 is fitted on the collar portion 11*c* of the lens 11, and the lens 11 is mounted on the frame 2 so as to insert its one side having the packing 12 into the opening of the frame 2, and to insert the other side or curved surface side of the lens 11 into the cooling liquid chamber 2*d* of the frame 2. The small protrusions 11*d* formed at the four corners of the lens 11 are made to abut against the protrusions 2*f* of the frame 2, respectively, to thereby dispose the lens 11 in correct position on the frame 2. Thus, a predetermined positional relationship can be always maintained between the projection cathode ray tube 1 and the lens 11, both of which are disposed in position on the frame 2.

The lens adaptor plate 13 is fitted on the lens 11, and the screws 14 are tightened into the protrusions 2*f* of the frame 2, so that the lens 11 is securely attached onto the frame 2. When the lens 11 is attached onto the frame 2 through this lens adaptor plate 13, the collar portion 11*c* of the lens 11 is sandwiched between the packing 12 and the step portion 13*b* of the lens adaptor plate 13. The packing 12 and the step portion 13*b* are disposed at the opposite side surfaces of the collar portion 11*c*, so that the whole collar portion 11*c* of the lens 11 is pressed uniformly. Accordingly, no bending stress is exerted onto the collar portion 11*c* of the lens 11, so that the lens 11 is not damaged. Further, the lens 11 has a cross section in plan view in the shape of a circle cut at four edges at right angles to be rectangular. Therefore the lens 11 can be reduced in size, even where the lens 11 has a large radius of curvature. Accordingly, it is possible to dispose the projection cathode ray tubes more closely adjacent to each other, so that the respective optical axes of the projection cathode ray tubes are made substantially equal in length to each other. This makes it possible to make the color tone more uniform in intensity.

Further, the lens 11 is shaped to be substantially rectangular in plan view with substantially perpendicular wall portions 11*b*. As a result, there is a possibility that projection light rays from the lens 11 may be reflected by the perpendicular wall portions 11*b* to interfere with other such rays. Therefore, in this embodiment, light-shading portions 13*a* each having a size substantially the same as the perpendicular wall portion 11*b* are formed on the lens adaptor plate 13 and are coated to prevent reflection. The respective light-shading portions 13*a* are arranged on the respective inner surfaces of the perpendicular wall portions 11*b* of the lens 11 to prevent the projection light from being reflected, so that no interfering light is generated.

The diaphragm 15 is fitted onto the pressure regulating chamber 2*g* of the frame 2 and the fastening ring 16 is fastened onto the frame 2 by screws to thereby fix the diaphragm 15 on the frame 2. The cap 17 is attached onto the opening of the fastening ring 16.

The cooling liquid A is poured into the cooling liquid pouring hole 2*i* of the frame 2 so as to fill a space defined by the diaphragm 15, the projection face of the projection cathode ray tube 1, and the curved surface of the lens 11, with the cooling liquid A. There is a possibility that air may remain in an upper portion of the space after the space has been filled with the cooling liquid A. Therefore, in this embodiment, the taper surface 2*j* is formed in the lower surface of the cooling liquid pouring hole 2*i* so that air can be discharged out of the cooling liquid pouring hole 2*i* along the taper surface 2*j*. As a result, air never remains in the space, and the space is completely filled with the cooling liquid A. The packing 3 is attached onto the cooling liquid pouring hole 2*i* by a screw 3*a* to seal the cooling liquid A.

Although the cooling liquid pouring hole 2*i* is sealed by the packing 3 and the screw 3*a* in this embodiment, alternatively, a hollow rubber member with a flange may be used. That is, the hollow rubber member may be inserted into the cooling liquid pouring hole 2*i*, and a plug made of stainless steel, aluminum alloy, brass, or the like, may be fitted into a hollow portion of the hollow rubber member. In this case, an expanded portion is formed on an inner periphery of the hollow portion of the hollow rubber member at a lower portion of the rubber member to be projected down from the lower surface of the cooling liquid pouring hole 2*i*. The expanded portion is extended outward when the plug is tightened into the hollow portion to thereby tightly seal the lower surface of the cooling liquid pouring hole 2*i*. This improves the sealing of the cooling liquid pouring hole 2*i*.

When this cooling liquid A is sealed, if a signal is applied to the projection cathode ray tube 1 and the projection cathode ray tube 1 is heated, the cooling liquid A is expanded. However, the expansion of the cooling liquid A can be absorbed by the diaphragm 15, so that an excess pressure is not applied to the projection cathode ray tube 1 and the lens 11. Further, the temperature of the cooling liquid A is kept lower than a predetermined value, because the cooling liquid A is circulated in the space to be cooled by the frame 2.

Further, if the temperature of the cooling liquid A is increased, the lens 11 is heated and expands to cause the four corners of the lens 11 to abut against the protrusions 2*f* of the frame 2, respectively. Thus, stress is exerted onto the lens 11 creating a risk of damage of the lens 11. In this embodiment, however, the small protrusions 11*d* are formed at the four corners of the lens 11, respectively, so that the small protrusions may be deformed to avoid any stress exerted on the lens 11, and to prevent the lens 11 from being damaged.

According to the present invention, a 1,3-butalene glycol is used as the cooling liquid A.

Accordingly, the reflection factor $R_1$ at the boundary between the front face of the projection cathode ray tube 1 and the cooling liquid A becomes $$R1 = \left(\frac{1.54 - 1.441}{1.54 + 1.441}\right)^2 \times 100 = 0.110\%$$

where 1.54 and 1.441 are values of the refractive indices of the glass and the cooling liquid A, respectively. The reflection factor $R_2$ at the boundary between the plastic lens 11 and the cooling liquid A becomes $$R1 = \left(\frac{1.492 - 1.441}{1.492 + 1.441}\right)^2 \times 100 = 0.0302\%$$

where 1.492 is a value of the refractive index of the plastic material.

Accordingly, the total reflection factor becomes 0.142%, which is a value smaller than a half of that in the case where the conventional cooling liquid is used.

By use of 1,3-butylene glycol as the cooling liquid A, the vapor pressure of the 1,3-butylene glycol per se has such a very low value as to be not higher than 0.00008 (atm) at 20° C., and therefore the vapor pressure of the cooling liquid A can be made smaller than the conventional one. Accordingly, the projection cathode ray tube 1 and the lens 11 can be prevented from being damaged owing to the evaporation and the reduction of the cooling liquid A due to its own evaporation can be made little (the packing or the like made of silicon resin has gas permeability so that vapor may leak out through the packing or the like when the quantity of vapor is large).

In addition, having extremely low corrosiveness to metal and plastics, 1,3-butylene glycol not only does not degrade the frame or the like by corrosion but never dissolve plastics, so that the plastic lens 11 can be made to directly touch the cooling liquid, and therefore it becomes unnecessary to use the conventional glass plate 22. Accordingly, if the distance between the projection cathode ray tube 1 and the lens 11 be the same as in the conventional one, the space in which the cooling liquid A is sealed can be made larger. Further, having small viscosity of 104 cps (centi-poise) at 25° C., 1,3-butylene glycol can be easily circulated by convection so that the cooling efficiency can be improved correspondingly. That is, according to the embodiment of the present invention, the temperatures become 68° C. and 55° C. respectively at the central portion of the projection cathode ray tube 1 and at the peripheral portion of the same. Thus, the temperature at the central portion of the projection cathode ray tube 1 can be made lower by 52° C. than that in the case where the projection cathode ray tube 1 is not cooled, and the temperature difference between the central and peripheral portions is only 13° C. Accordingly, it is possible to reduce the thermal stress exerted onto the front face of the projection cathode ray tube 1, resulting in improvement in reliability of the projection apparatus.

When a mixed liquid of 1,3-butylene glycol and glycerin is used as a cooling liquid, the viscosity of glycerin never influences the convection so much if the liquid mixture contains about 30 weight % of glycerin at maximum.

Further, 1,3-butylene glycol has little poison as can be seen by the fact that it is used in products such as toilet water, shampoo, toothpaste, and so on, and therefore safety in work can be improved.

When a mixed liquid of 1,3-butylene glycol and ethylene glycol is used as the cooling liquid, it is preferable in view of safety to restrict the weight ratio of ethylene glycol to about 50% at maximum.

Further, as shown in the above table, the value of refractive index of 1,3-butylene glycol is 1.441, so that it is unnecessary to control the refractive index by using a mixed liquid, unlike the conventional case, to thereby make it easy to manufacture the cooling device. Because 1,3-butylene glycol has a hydrophilic property, it is possible to obtain a cooling device in which stable performance can be maintained in use for a long time even if permeation of external water is taken into consideration. Further, being colorless and transparent, 1,3-butylene glycol has a flat frequency characteristic with respect to transmission light and therefore is suitable for use in optical systems such as video projection systems or projection television receivers, etc.

It is needless to say that a mixed liquid in which ethylene glycol or glycerin is mixed with 1,3-butylene glycol can be used as the cooling liquid A as described above.

As described above, according to the present invention, 1,3-butylene glycol, a mixed liquid consisting of 1,3-butylene glycol and ethylene glycol, or mixed liquid consisting of 1,3-butylene glycol and glycerin, is used as the cooling liquid for cooling the front surface of the projection cathode ray tube, so that there are such effects that contrast can be made largely higher than the conventional case because of a small reflection factor at the boundary surface, the projection cathode ray tube, and the like, are hardly damaged because the quantity of evaporation of the cooling liquid is small to make the vapor pressure low, and the device can be reduced in weight as well as in size to thereby lower the cost because a plastic lens can be made to directly touch the cooling liquid.

In the embodiment according to the present invention, it is not necessary to control the refractive index by using the mixed liquid, unlike the conventional case, so that it is possible to obtain a cooling device which is easily manufactured and which maintains stable performance in use for a long time.

What is claimed is:

1. A projection television receiver comprising at least one cathode ray tube for receiving video signals and projecting images therefrom, said tube including a face;

lens means mounted adjacent said face for focusing the images projected by said tube; and coolant means between said lens means and said face for absorbing and dissipating heat from said tube, said coolant means consisting essentially of a liquid selected from the group consisting of 1,3-butylene glycol, a mixture of 1,3-butylene glycol and a glycerin and a mixture of 1,3-butylene glycol and ethylene glycol.

2. The receiver of claim 1, wherein said liquid is a mixture of 1,3-butylene glycol and ethylene glycol and contains not more than about 50 weight % ethylene glycol.

3. The receiver of claim 1, wherein said liquid is a mixture of 1,3-butylene glycol and glycerine and contains not more than about 30 weight % glycerin.

4. The receiver of claim 1, wherein said liquid is 1,3-butylene glycol.

5. The receiver of claim 1, wherein said lens means is a plastic lens.

6. A cooling device for cooling a projection cathode ray tube with a cooling liquid in a projection television receiver, wherein said tube has a face, a plastic lens for focusing images projected by said tube is mounted adjacent said face, and a chamber for containing said cooling liquid is defined by said face and said lens, in which the cooling liquid in said chamber consists essentially of a liquid selected from the group consisting of 1,3-butylene glycol, a mixture of 1,3-butylene glycol and glycerin, and a mixture of 1,3-butylene glycol and ethylene glycol.

7. The cooling device of claim 6, wherein said cooling liquid is a mixture of 1,3-butylene glycol and ethylene glycol and contains not more than about 50 weight % ethylene glycol.

8. The cooling device of claim 6, wherein said cooling liquid is a mixture of 1,3-butylene glycol and glycerin and contains not more than about 30 weight % glycerin.

9. The cooling device of claim 6, wherein said liquid is 1,3-butylene glycol.

* * * * *